US005535467A

United States Patent [19]

Ciske

[11] Patent Number: 5,535,467

[45] Date of Patent: Jul. 16, 1996

[54] ADJUSTABLE AND MULTIPLE-USE PILLOW

[76] Inventor: Paul E. Ciske, Oakland, Calif.

[21] Appl. No.: 402,554

[22] Filed: Mar. 13, 1995

Related U.S. Application Data

[63] Continuation-in-part of Ser. No. 196,558, Feb. 15, 1994, abandoned.

[51] Int. Cl.[6] ..... A47G 9/00

[52] U.S. Cl. ..... 5/636; 5/922; 5/639; 5/643

[58] Field of Search ..... 5/636, 639, 643, 5/645, 490, 491, 922

[56] References Cited

U.S. PATENT DOCUMENTS

| | | | |
|---|---|---|---|
| 3,174,163 | 3/1965 | Gibson | 5/640 |
| 3,555,580 | 1/1971 | Willis | 5/636 |
| 3,602,928 | 9/1971 | Helzer | 5/338 |
| 3,667,074 | 6/1972 | Emery | 5/337 |
| 3,698,023 | 10/1972 | Archbold | 5/337 |
| 4,501,034 | 2/1985 | Greenawalt | 5/441 |
| 4,513,462 | 4/1985 | Thomas | 5/442 |
| 4,528,981 | 7/1985 | Behar | 5/922 X |
| 4,550,459 | 11/1985 | Endel | 5/436 |
| 4,682,691 | 7/1987 | Spiering | 206/373 |
| 4,754,513 | 7/1988 | Rinz | 5/434 |
| 4,761,872 | 8/1988 | Buettner et al. | 5/636 X |
| 4,908,894 | 3/1990 | Sanders | 5/436 |
| 5,020,174 | 6/1991 | Sarkozi | 5/437 |
| 5,271,114 | 12/1993 | Kjersem | 5/640 |
| 5,297,304 | 3/1994 | Ciske | 5/630 |

*Primary Examiner*—Michael F. Trettel

[57] ABSTRACT

A pillow that forms into a head and neck roll support, as well a support for other body parts. The pillow is continually adjustable to the user's individual body shape and requirements. The pillow has two rectangular layers of woven material (22*a*, 22*b*), covering a core layer of filler material (24), and fasteners (20*a*, 20*b*, 28*a*, 28*b*) for securing the pillow body (30) in folded and rolled spiral configurations of various shapes and sizes.

16 Claims, 3 Drawing Sheets

ADJUSTABLE AND MULTIPLE-USE PILLOW

This application is a continuation in part of application Ser. No. 08/196,558, filed Feb. 15, 1994, now abandoned.

BACKGROUND

1. Field of Invention

This invention relates to body supports. In particular it relates to support cushions which are individually adjustable for supporting the neck, head, and low back.

2. Description of Prior Art

Heretofore, support cushions have had varying contours and adjustments to provide support for the varying head, neck and back contours of different individuals. However, head and neck support cushions have generally been designed for use in a supine or sleeping position while support cushions for the back are designed for use when sitting. The need for head, neck and back support is also desireable when resting in a sitting, lying, or semi-recumbent position and when doing exercises on the floor or on strength training machines. In these different body positions the needed amount of head, neck and back support varies. A support cushion therefore ideally needs to be readily adaptable in size and shape for a variety of situations.

Most current methods for adjustment are not conducive for conveniently both increasing and decreasing the size of neck, head and back support for various uses. For example, U.S. Pat. No. 4,908,894 issued to Sanders in March 1990 establishes the size of the cervical support by cutting a foam pad therefore eliminating the possibility of increasing the size again. Sanders' patent also requires extra pieces to adjust the support behind the head making it inconvenient to change for different postures.

The inflatable support cushions (e.g., U.S. Pat. No. 3,602,928 to Helzer in September 1971; and U.S. Pat. No. 4,501,034 to Greenawalt in February 1985) meet this need of convenience through inflation and deflation of the cushion. The problem these cushions present is that they do not hold their shape especially when partially deflated. As pressure is applied to the cushion, the air shifts to other parts of the chambers making it difficult to get the appropriate size and support.

U.S. Pat. No. 3,174,163 to Gibson in March of 1965 also shows an adjustable pillow-roll with a means for adjusting the size of the rolls in the cushion. However, the pillow is designed to adjustably support the sides of the head rather than the back of the head and neck. The holding means for the rolled configurations is also limiting. If the securing straps are in any position other than the bottom side of the spiral roll (i.e., top or side) the roll will either be deformed by the securing straps or the spiral will partially unroll. Therefore the shape and size of the rolls are limited to those in which the securing straps are in the lowest most position in the spiral. The means for holding the rolls is also not conducive for securing the resilient pillow member in a folded configuration. In addition, the securing straps must be disconnected and reconnected to adjust the rolls making them inconvenient.

U.S. Pat No. 4,528,981 to Behar in July of 1985 shows a cervical immobilization device. The device is used to restrain the head and cervical spine between two resilient head support rolls. The distance between the rolls is adjustable by an interconnecting means for fixing the position of the rolls. The means for fixing the positions comprises an interlocking hook and loop fastening fabric being positioned on the straps and about the periphery of the head rolls. However, the head rolls are of a fixed shape and can not be adjusted to support the back of the head and neck.

U.S. Pat. No. 5,297,304 to O'Sullivan is the only support cushion in which the cushion can be readily increased and decreased in size. The support is varied by rolling different amounts of the cushion into a spiral which is secured by complementary strip fastening means attached parallel to the long edge of the cushion on its opposing surfaces. There are several limitations to this design. Due to the positioning of the fastening means, the cushion can only be rolled and secured into a spiral in a direction substantially parallel to its length. The configurations into which the cushion can be shaped is therefore limited. Also, the width of support is limited to the width of the cushion. In contrast, the width of the support needed for a person's head and neck is less than that needed for one's back. Ideally a support cushion would be adaptable to both needs as well as configuring into shapes which accurately contour and support various parts of the body. Another limitation of the support cushion by O'Sullivan is that there is no means for connecting together two or more cushions if a greater length or width is desired. For example, a greater length may be desired so that both the neck and low back can be supported at the same time by a single unit. Another problem with this cushion is in the production. In order for the cushion to be secured in the spiral configuration the complementary strip fastening means on the opposing surfaces must be aligned making it more difficult to manufacture.

OBJECTS AND ADVANTAGES

Accordingly, several objects and advantages of my invention are:

(a) to provide an inexpensive support cushion which has greater usefulness due to its ability to be rolled in any direction and configured into innumerable shapes;

(b) to provide a support cushion which meets the variety of needs for support by the head, neck, back, and other areas of the body of different individuals and a given individual in different postural positions;

(c) to provide a support cushion which can be connected with one or more support cushions so that an even greater variety of needs for support can be met such as supporting the head, neck and back, or the sides of the head and the neck, at the same time with a single unit.

(d) to provide a support cushion which is easier and less expensive to manufacture due to having fewer components.

Further objects and advantages of my invention will become apparent from a consideration of the drawings and ensuing description of it.

DRAWING FIGURES

REFERENCE NUMERALS IN DRAWINGS

20*a* Lengthwise hook fastener

20*b* Widthwise hook fastener

Figure 1:
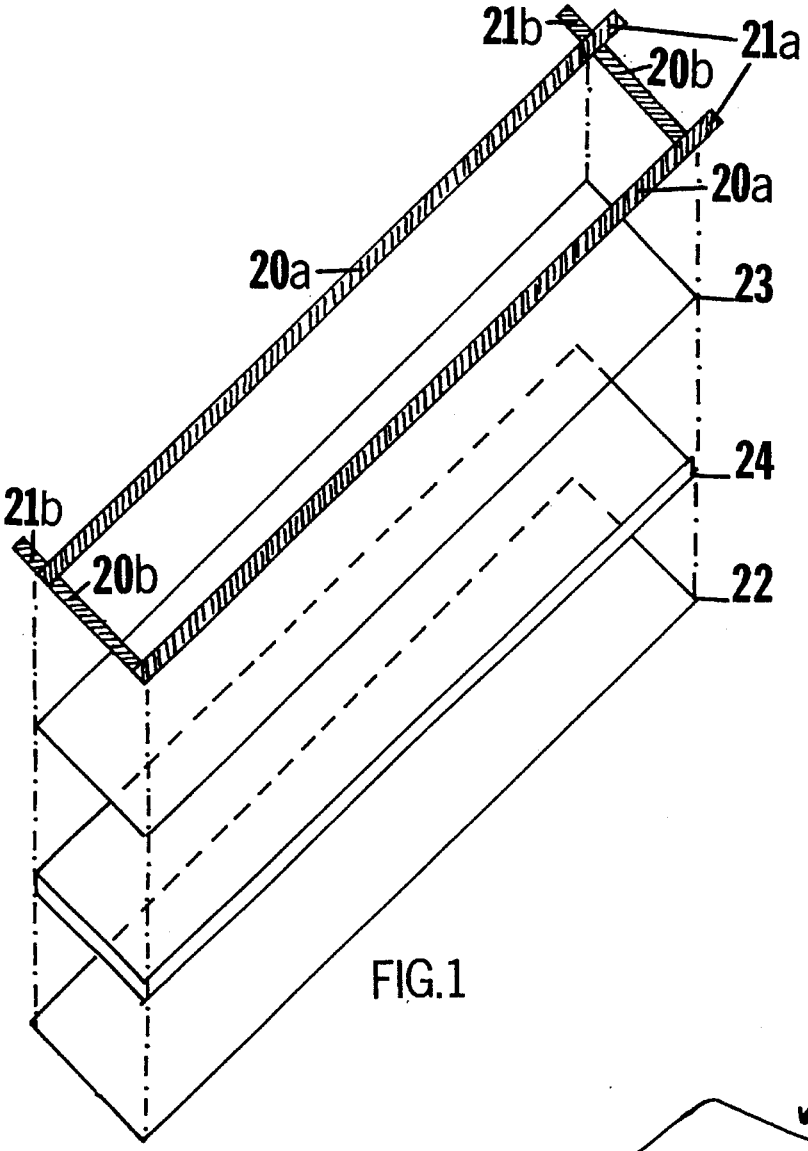
FIG. 1 is an exploded view of the invention.

21*a* Lengthwise connecting tabs for connecting cushions end to end

21*b* Widthwise connecting tabs for connecting cushions side by side

22 Upper surface material releasably engageable by hook fastener

23 Lower surface material

24 Filler material

26 Foam

30 The cushion body—three layers stitched together

32 Spiral rolled section for neck support

34 Folded section for head support

36 Spiral rolled in a direction substantially parallel to the width.

38*a&b* Material engageable by hook fastener

Figure 2:
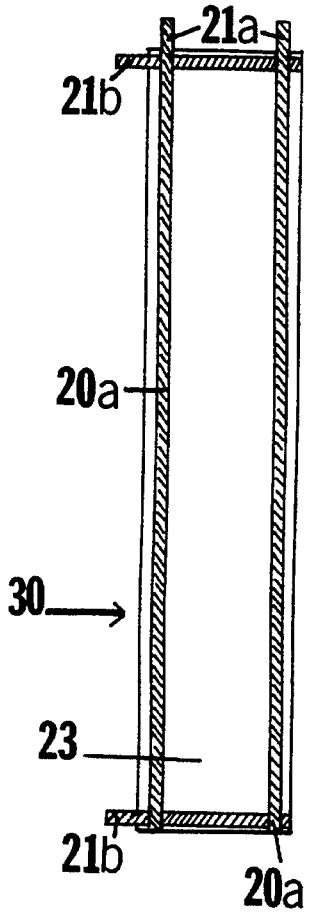
FIG. 2 is a bottom view of the assembled pieces.

DESCRIPTION—FIGS. 1 and 2

FIG. 1 shows an exploded view of the invention. The central layer of the invention is preferably a rectangularly shaped piece of filler material 24 although it may be of any shape that has a length and width dimension. Filler material 24 is made of one or a combination of several possible materials including fibrous polyester batting, fibrous polyester fleece and sheet foam rubber. Filler material 24 provides cushioning in the assembled cushion.

The bottom surface of the filler material 24 is covered by a lower surface material 23 of the same shape. A variety of types of material can be used such as a cotton, or cotton/polyester blend but may also be of a material which releasably engageable by hook fastener 20*a&b*.

Figure 10:
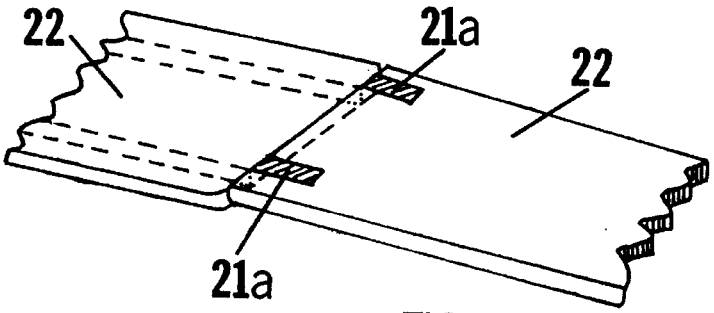
FIG. 10 is the invention connected sequentially with a second support cushion.

A strip or strips of hook fastener 20*a&b* are sewn to lower surface material 23 substantially parallel to at least the lengthwise edges but also can be sewn parallel to the widthwise edges. Lengthwise hook fastener 20*a* is perferably longer than the length of lower surface material 23. The excess length creates lengthwise connecting tabs 21*a* which allow for connecting cushions end to end. FIG. 10 shows lengthwise connecting tabs 21*a* engaged to the upper surface material 22 of a second cushion. Widthwise hook fastener 20*b* can be sewn parallel to each end or at intervals along the length and would preferably be wider than the width of lower surface material 23. The excess width creates widthwise connecting tabs 21*b* which allow for connecting cushions side by side. However, the measure of hook fastener 20*a&b* can range from a portion of, to greater than, the length and width, respectively, of lower surface material 23.

Filler material 24 is covered on the top surface by upper surface material 22 of the same shape. Upper surface material 22 is of a type which hook fastener 20*a&b* can releasably engage. Upper surface material 22 and lower surface material 23 are sewn together along their edges to completely encase filler material 24. The assembled form is shown in FIG. 2 and hereforth designated as a cushion body 30. Quilting stitching may be sewn the length of cushion body 30 to further secure the three layers.

Cushion body 30 can be rolled and folded in lengthwise, widthwise and diagonal directions. These configurations are secured by hook fastener 20*a&b* engaging, at least, upper surface material 22, and lower surface material 23 if it is of the type to which hook fastener 20*a&b* is engageable.

OPERATION—FIGS. 2, 3, 4, 5, 6

Figure 3:
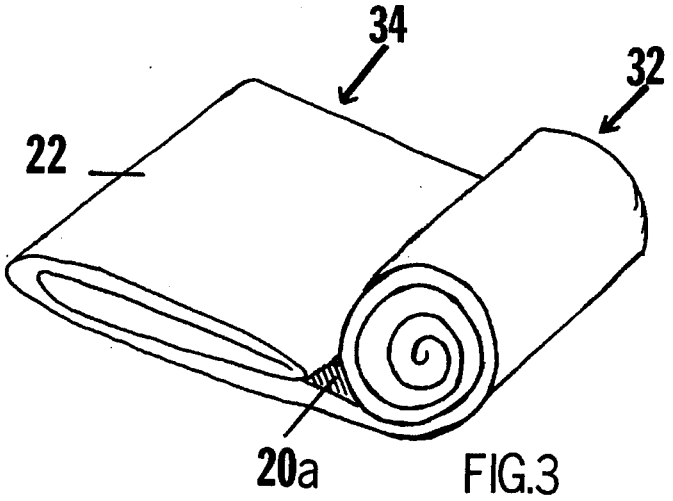
FIG. 3 is the first embodiment of the invention.

FIG. 2 shows a bottom view of cushion body 30 prior to configuring it into the first embodiment of FIG. 3. The first embodiment is created by laying out cushion body 30 with hook fastener 20*a&b* facing upward. Cushion body 30 is rolled into a spiral 32 from one of the narrow ends for approximately half of its length. In this process, upper surface material 22 is engaged by hook fastener 20*a&b* so that rolled spiral 32 is secured. The remaining length of cushion body 30 is folded into thirds towards rolled spiral 32 to form a folded section 34 of the first embodiment FIG. 3.

In this embodiment spiral rolled section 32 serves as a support for the neck. Folded section 34 serves as a support for the head. The amount of neck support can be increased or decreased by respectively rolling more or less of the length of cushion body 30 into spiral 32. The firmness of neck support can be increased or decreased by respectively rolling cushion body 30 looser or tighter. The amount of support behind the head can be increased or decreased by respectively making more or less folds in folded section 34. The entire length can also be rolled into a spiral to form a cylindrical neck bolster.

Figure 4:
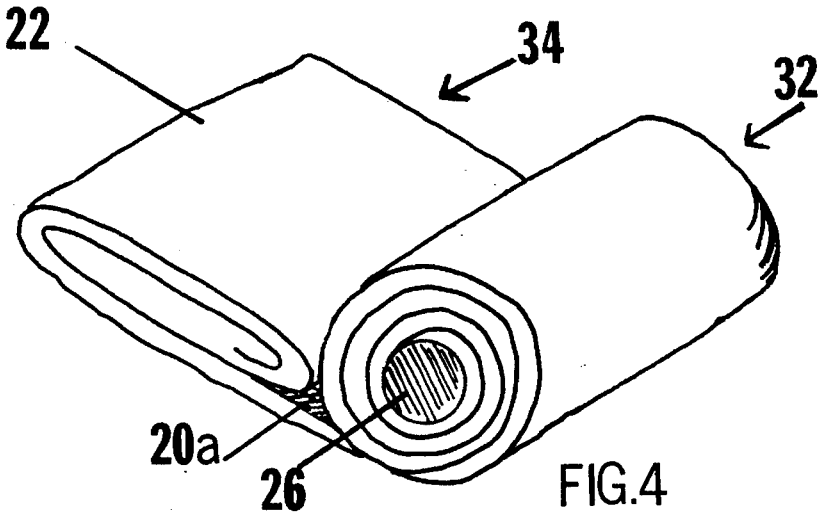
FIG. 4 is the first embodiment of the invention with a piece of foam in the center of the spiral roll for shaping and added cushioning.
Figure 7:
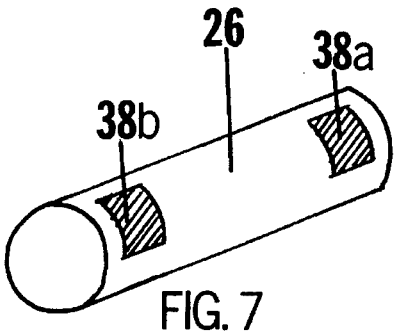
FIG. 7 is the piece of foam placed in the center of the spiral roll for shaping and added cushioning.

FIG. 4 shows the first embodiment of the invention with a piece of foam 26 in the center of spiral roll 32. FIG. 7 shows foam 26 with material engageable by hook fastener, hereforth designated hook engageable material 38*a&b*, adhered to it. Foam 26 is rubber-like material preferably synthetic foam rubber. The length of foam 26 is the same as the width of cushion body 30 although it may also be narrower or wider. Foam 26 can be of a variety of firmness and shapes (i.e., round, square, oval, etc.) in order to adjust the shape and firmness of the first embodiment. Hook engageable material 38*a&b* are adhered to foam 26 at the same distance apart as the strips of hook fastener 20*a* attached to lower surface material 22. Alternatively, foam 26 is covered with hook engageable material. Hook engageable material 38*a&b* on foam 26 releasably attaches to hook fastener 20*a* on the lower surface of cushion body 30. Alternatively, foam 26 may be permanently attached to the narrow edge or edges of cushion body 30.

If the cushion is to be used consecutively by more than one person, it can be enclosed in a casing, or a changeable piece of fabric with hook fastener attached can be releasably engaged to upper surface material 22 to maintain cleanliness.

Figure 5:
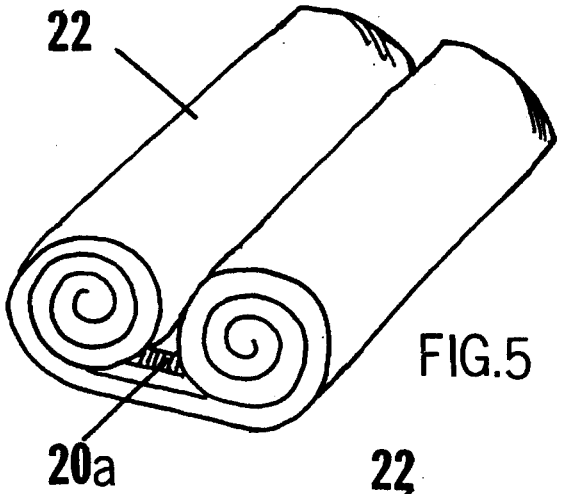
FIG. 5 is a second embodiment of the invention which is used to support the head in a neutral position while lying prone.
Figure 8:
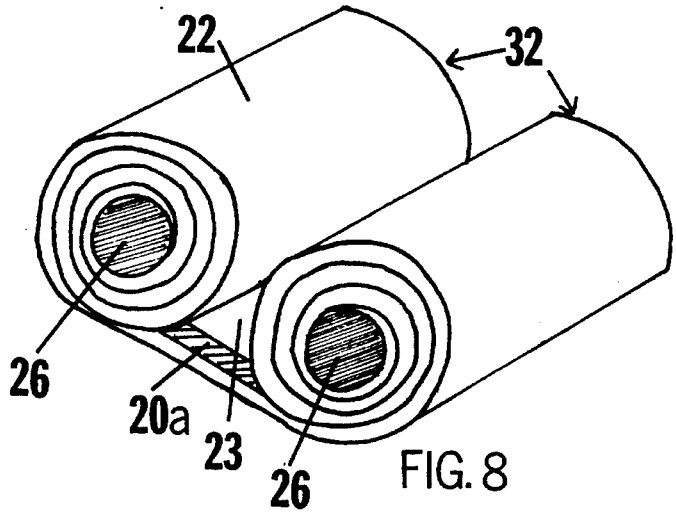
FIG. 8 is the second embodiment of the invention with a piece of foam in each of the spiral rolls for shaping and added cushioning.

FIG. 5 is a perspective view of a second embodiment of the invention. The embodiment is formed by laying out cushion body 30 with hook fastener 20*a&b* facing upward. Each of the two narrow edges is consecutively rolled substantially parallel to the length to form two spiral rolls of equal size that meet in the center. In the rolling process hook fastener 20*a&b* engages upper surface material 22, which secures the spiral rolls in place. This embodiment supports the head in a neutral position when a person lies prone (i.e., face down). FIG. 8 shows the second embodiment with two pieces of foam 26, described above, in the center of each of the spiral rolls.

Alternatively, a space can be left between the spiral rolls in the second embodiment and cushion body 30 is folded diagonally so that upper surface material 22 of each of the spiral rolls is engaged by hook fastener 20*a*. Cushion body 30 is then folded in half so the spiral rolls lie next to each other.

Figure 6A:
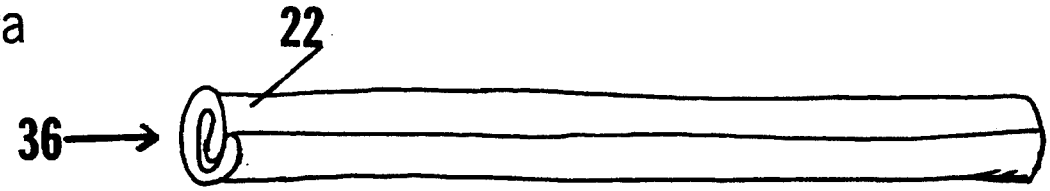
FIG. 6A and 6B is a third embodiment of the invention which is used for low back support.
Figure 6B:
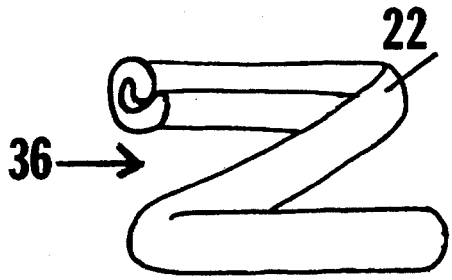

FIG. 6 is a perspective view of a third embodiment of the invention. The third embodiment is formed by laying out cushion body 30 with hook fastener 20*a&b* facing upward. The lengthwise edge of cushion body 30 is rolled substantially parallel to the width so that upper surface material 22 is engaged by hook fastener 20*a* of the opposite lengthwise edge and by hook fastener 20*b* attached widthwise to lower surface material 23. The configuration formed is a lengthwise spiral shape 36. Lengthwise spiral shape 36 is folded into thirds and placed under the low back while lying in a supine position. The amount of support is increased or decreased by the tightness of the spiral and the number of folds placed in lengthwise spiral shape 36.

Figure 9:
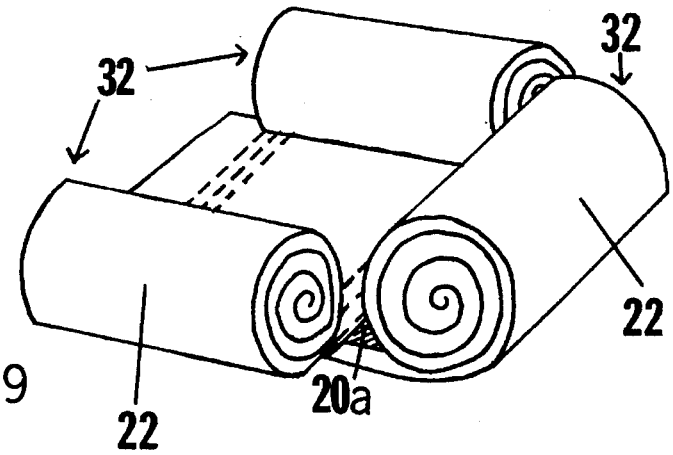
FIG. 9 is the invention configured into the first embodiment combined with another one of the inventions configured into the second embodiment.

FIG. 9 is a perspective view of two cushion body 30 used in conjunction with each other. This embodiment is formed by configuring one cushion body 30 into the second embodiment with two spiral rolls of the same size. A space, the size of the width of a second cushion body 30, is left between the spiral rolls. The second cushion body 30 is partially configured into the first embodiment with half of cushion body 30 rolled into a spiral. The section between the spiral rolls of the first cushion body 30 is placed, with upper surface material 22 facing downward, across the width of the unrolled end of the second cushion body 30 with its hook fastener 20*a* facing upward. The unrolled section of the second cushion body, with the first cushion body 30 attached perpendicularly at the end, is folded toward the spiral roll to form the embodiment shown in FIG. 9. This configuration of two cushion body 30 is used to hold the head in a neutral and face forward position while sleeping in a supine, sitting or semi-recumbent position.

CONCLUSION, RAMIFICATIONS AND SCOPE

Thus the reader will see that the cushion of this invention provides a simple, easy to use, washable and economical device which is adjustable for the varying needs of head, neck, and back support by people of all sizes. The invention has several advantages over the prior art. The advantages are:

1) In the first embodiment, the spiral roll which supports the neck and the folded section which supports the head can both be increased and decreased easily and without added pieces;

2) The cushion has greater usefulness due to its ability to be rolled and folded in any direction and configured into innumerable shapes, therefore meeting the variety of needs for support by the head, neck, back and other areas of the body of different individuals and a given individual in different postural positions.

3) The cushion can be connected with one or more other support cushions so that an even greater variety of needs for support can be met such as supporting the head, neck and back, or the sides of the head and the neck at the same time with a single unit.

4) The invention does not require loop fastener juxtaposed to the hook fastener making it simpler and more economical to manufacture;

5) The construction of the cushion makes it easily launderable;

While the above description contains details of construction and many uses, these should not be construed as limitations on the scope of the invention, but rather as an exemplification of the first embodiment and a few variations. Many other variations are possible. For example, the invention may be wrapped around the waist. In this use it will offer support to the back and remind the user to engage their abdominal muscles. The invention may also be wrapped around other body parts to hold an ice pack in place. The invention can be affixed to the headrest of a car without any other attaching device and used as a neck support. A section of the cushion body can be rolled into a spiral from one narrow end with the remaining section then being attached or laid over the back of a chair in order to support the low back. The alternative double spiral configuration may be placed around the neck and used as a travelling pillow. Due to the innumerable configurations it could also be used as a toy or game. Large size cushions made with foam rubber could be used for mats and forming large tubular and spiral shapes.

Accordingly, the scope of the invention should be determined not by the embodiments illustrated but by the appended claims and their legal equivalents.

I claim:

1. A cushion comprising:

a cushion body consisting of filler material layered between a lower and upper surface material of the same shape as said filler material; and a releasable engaging means, attached to said lower surface material and directly engageable to said upper surface material, which connects sections of, or the entire said lower surface material to said upper surface material whereby a continuous variety of sizes and shapes of folded, spiraled and rolled configurations can be secured and individually adjusted in order to support different parts of a human body.

2. A cushion as defined in claim 1 in which said releasable engaging means for connecting said upper and said lower pieces of woven material is hook fastener.

3. A cushion as defined in claim 1 in which both said upper and said lower pieces of surface material are of a type engageable by said releasable engaging means.

4. A cushion as defined in claim 1 in which a piece of cushioning material is rolled into the center of a spiral configuration of one or both ends of said cushion body whereby a variety of shapes, sizes, and cushioning densities can be achieved.

5. A cushion as defined in claim 4 in which said cushioning material is attached to one or each said end of said cushion body.

6. A cushion as defined in claim 4 in which said piece of cushioning material is releasably attached to one or each said end of said cushion body by complementary connectors attached to said cushion body and said cushioning material.

7. A cushion as defined in claim 6 in which said complementary connector attached to said cushioning material is material engageable by hook fastener.

8. A cushion as defined in claim 1, further including a second said pillow with said upper surface material releasably engaged by said releasable engaging means attached to said lower surface material of first said cushion.

9. A cushion comprising:

a cushion body consisting of filler material layered between an upper piece of surface material, which is of a type engageable by a releasable engaging means, and a lower piece of surface material, both being of the same shape as said filler material; and said releasable engaging means, attached to said lower piece of surface material, which connects sections of, or the entire said lower piece of surface material to said upper piece of surface material whereby a continuous variety of sizes and shapes of folded, spiraled and rolled configurations can be secured and individually adjusted in order to support different parts of a human body.

10. A cushion as defined in claim 9 in which said releasable engaging means for connecting said upper and said lower pieces of woven material is hook fastener.

11. A cushion as defined in claim 9 in which both said upper and said lower pieces of surface material are of a type engageable by said releasable engaging means.

12. A cushion as defined in claim 9 in which a piece of cushioning material is rolled into the center of a spiral configuration of one or both ends of said cushion body whereby a variety of shapes, sizes, and cushioning densities can be achieved.

13. A cushion as defined in claim 12 in which said cushioning material is attached to one or each said end of said cushion body.

14. A cushion as defined in claim 12 in which said piece of cushioning material is releasably attached to one or each said end of said cushion body by complementary connectors attached to said cushion body and said cushioning material.

15. A cushion as defined in claim 14 in which said complementary connector attached to said cushioning material is material engageable by hook fastener.

16. A cushion as defined in claim 9, further including a second said pillow with said upper surface material releasably engaged by said releasable engaging means attached to said lower surface material of first said cushion.

* * * * *